United States Patent [19]

Wiles

[11] Patent Number: 4,682,707

[45] Date of Patent: Jul. 28, 1987

[54] CONTAINER HAVING A TAMPER PROOF LID

[75] Inventor: Keith E. Wiles, Norfolk, England

[73] Assignee: National Can Corporation, Chicago, Ill.

[21] Appl. No.: 831,924

[22] Filed: Feb. 14, 1986

Related U.S. Application Data

[63] Continuation-in-part of Ser. No. 748,512, Jun. 25, 1985, abandoned.

[30] Foreign Application Priority Data

Jan. 11, 1985 [GB] United Kingdom ..... 8500701
Feb. 18, 1985 [GB] United Kingdom ..... 8504132

[51] Int. Cl.[4] ..... B65D 39/00
[52] U.S. Cl. ..... 220/307; 220/284; 220/266; 220/DIG. 19
[58] Field of Search ..... 220/307, 284, 266, DIG. 19

[56] References Cited

U.S. PATENT DOCUMENTS 3,595,421 7/1971 Sanchis ..... 215/DIG. 1
4,327,842 5/1982 Walter ..... 220/307
4,491,238 1/1985 Tobolt ..... 220/307

*Primary Examiner*—George T. Hall
*Attorney, Agent, or Firm*—Robert A. Stenzel; Ralph R. Rath

[57] ABSTRACT

A one-piece plastic can lid 1, for use with a container of the lever ring type, has a periphery 20 which contacts an annular portion of the can wall 15, so as to center the lid 1 accurately relative to the can body. A recess 25 may be provided to enable a lever to be used to pry the lid 1 off the container. The recess 25 desirably includes a membrane 27 which is pierced when a lever is first used to open the container, so that rupture of the membrane 27 makes evident any unauthorized opening of the container. The lid 1 may also include one or more fins which form a seal in conjunction with an annular part 14 of the lever ring 16 of the container.

6 Claims, 6 Drawing Figures

IV 17
25
27
26
6
5
19
7
1
3
20
2
16
18
14
9
8
11
10
13
12
4
15

27
26
5
PURGE RELIEF
TO OPEN
29
28
29

CONTAINER HAVING A TAMPER PROOF LID

REFERENCE TO RELATED APPLICATION

This application is a Continuation-In-Part of U.S. Ser. No. 748,512, filed June 25, 1985, now abandoned.

TECHNICAL FIELD

This invention relates to containers with lids and is especially, but not exclusively, concerned with paint cans and other containers of the known kind which are provided with a lever ring, within which the lids fit in order to close the container. The lids of the containers of this invention can conveniently comprise one-piece plastic moldings, and the containers per se can be of many kinds, including plastic molded containers, tinplate containers and others.

BACKGROUND PRIOR ART

An improved form of lid, preferably of a plastic material, for use in lever ring and other kinds of containers, is described in British Appln. No. 8500701 (GB-A-2152913) and has a portion for sealingly engaging with a corresponding portion of a container to which the lid is to be fitted, wherein the lid portion comprises at least one flexible annular fin which extends generally radially outwardly of and circumferentially around the lid and which is arranged to be deformed when the lid is fitted to the container so as to provide sealing engagement between the lid portion and the container portion. The present invention provides a further improvement in lids of such kind and a complementary improvement in such kinds of containers.

The machinery used to put lids on containers is generally arranged to hold each lid in a generally horizontal position and either lower it into the ring of the container by moving it down the vertical axis of the latter or move it generally horizontally across the open top of a container in a slightly tilted attitude, so that a part of the periphery of the lid is abutted against the inside of the lever ring and a downward force is then applied at the opposite part of the periphery of the lid. Although the finned lids according to the aforementioned application are highly effective in sealing the containers to which they are fitted, misalignment can occur in a very small percentage of cases, which causes the fins to be excessively distorted at one part of the lid periphery, so that proper sealing is not achieved, for instance at the opposite part. In other words, the lids occasionally are not located in a generally concentric relationship with the lever rings of the associated containers and not even the natural tendency of the plastic material to achieve a condition of minimum stress is sufficient at times to allow a misaligned lid to centralize itself within the lever ring of the associated container. Misalignment is more likely to occur if the lids are applied by the second of the procedures mentioned or if they suffer damage at the periphery before or during application to the containers.

SUMMARY OF THE INVENTION

The present invention solves this problem in a simple and highly effective way, by providing corresponding components on the lid and the container, additional to those used to seal the one in relation to the other, which ensure at least substantially accurate centralizing of the lid in relation to the lever ring of the container. Also, the invention in a preferred embodiment couples this feature with tamper-evident means for opening such containers.

According to the present invention, a lid is provided, preferably of a plastic material, having a portion for sealingly engaging with a corresponding portion of a lever ring of a container to which the lids is to be fitted, wherein the container includes an annular surface concentric with the container portion and the lid includes an annular surface concentric with the lid portion and arranged to contact the annular surface of the container and thereby maintain the lid and container portions in a concentric, and therefore sealed, relationship.

Preferably, the annular lid surface is the periphery of a flange projecting outwardly from the lid portion, while the annular container surface is an inwardly-facing portion of the lever ring or container located radially outwardly from the container portion. In a preferred form of the lid, one or more recesses are provided in the peripheral part of the flange for receiving a lever for assisting in removal of the lid to open the container. In accordance with a preferred feature of this form of the lid of the invention, each recess includes a membrane which is ruptured or otherwise displaced when a lever is first used to assist removal of the lid from the associated container, whereby the lid is made tamper-evident. The lid is preferably provided with fins of the kind disclosed in theaforementioned application, so that the benefits of all these improvements are obtained together.

BRIEF DESCRIPTION OF SEVERAL VIEWS OF DRAWINGS

In order that the present invention may be understood and appreciated, a preferred embodiment of a container and a lid according to the invention is described below in conjunction with the accompanying drawings, in which.

DETAILED DESCRIPTION

Figure 1:
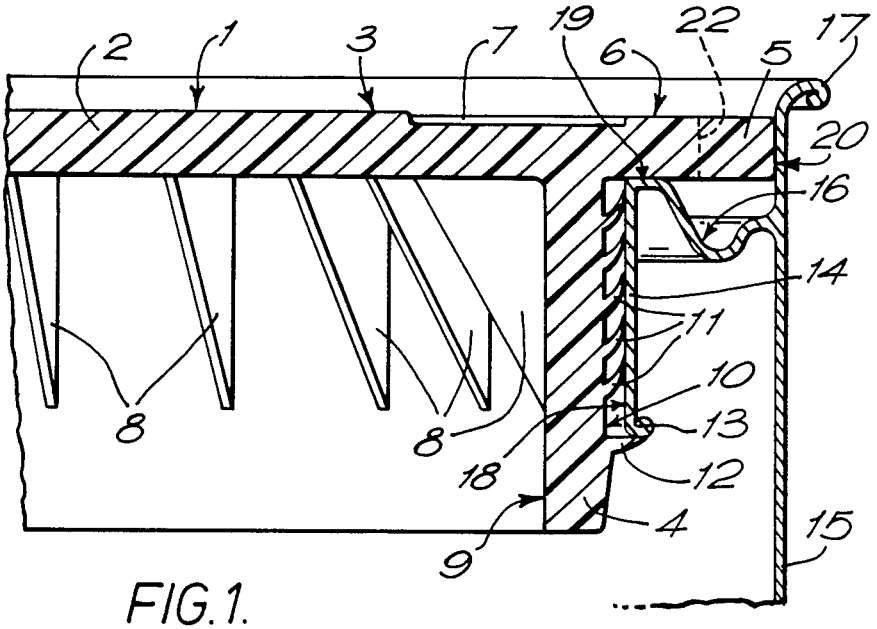
FIG. 1 shows, in a radial cross-sectional view, a paint can lid and the lever ring of a paint can to which the lid is fitted, according to a preferred embodiment of the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to FIG. 1 of the drawings, a lid 1 for a paint can is made of a suitable plastic material, for instance, polypropylene. The lid 1 comprises a flat central circular panel 2, a dependent annular wall 4 and a projecting flange 5, extending radially beyond the annular wall 4 and effectively constituting an outwardly continuation of the central panel 2. The undersides of the panel 2 and of the flange 5 can be generally coplanar, while the upper surface 3 of the panel 2 projects somewhat above the upper surface 6 of the flange 5. Between these upper surfaces 3 and 6, a wide shallow rectangular-section recess 7 is provided in the lid 1. The central panel 2 is thus somewhat thicker and therefore more resistant to bending than the part of the lid surmounted by the recess 7. On the underside, below the recess 7, a plurality of triangular ribs 8 extend between the inside surface 9 of the wall 4 and the underside of the lid panel 2.

On the exterior surface 10 of the wall 4, which is essentially cylindrical, a plurality of fins 11 are formed, there being five such fins 11, as shown in FIG. 1. Each fin 11 has a generally planar upper surface and an upwardly-coned or radiused under-surface, as described on the aforesaid application. A lowest fin 12 is provided also on the exterior surface 10 of the wall 4 and its purpose is to spring back into the normal position shown in FIG. 1 and engage beneath the rolled lower edge 13 of a cylindrical dependent web or annular wall or flange 14 of the lever ring of the can body. The wall of the can body is shown at 15 and the lever ring at 16. The can wall 15 extends above the lever ring 16 and terminates in an outwardly-rolled edge 17, which as shown clearly in FIG. 1 is generally located above the upper surfaces 3, 6 of the lid 1, when the latter is fitted in place. When the lid 1 is thus fitted in place, the fins 11 form a seal in conjunction with the inside annular surface 18 of the dependent web 14. In addition, the lowest fin 12 becomes located beneath the rolled lower edge 13 of the web 14, when the lid 1 has been fully pressed down into the lever ring 16 of the can body. The dependent web or flange 14, with its substantial and generally-cylindrical interior surface 18, is the radially-inward component of the lever ring 16, which typically includes a channel formation, connecting the top of the dependent web 14 to the interior of the wall 15 of the can. Between the dependent web 14 and the remainder of the lever ring 16, which forms a seat or flat annular surface 13 surrounding the dependent flange or wall 14 limiting further inward movement of the lid 1 into the can body which provides a secondary seal with the underside of flange 5.

In this position, the annular peripheral surface 20 consituted by the outer edge of the flange 5 of the lid 1 abutts against the interior surface of the can wall 15 located above the lever ring 16. The interaction between these confronting annular surfaces therefore assists considerably in centralizing the lid 1 in the lever ring 16 and thereby in the can body as a whole. Thus, the one or more fins 11 and the lowest fin 12 comprise one or more portions of the lid 1 and each of these fins 11 sealingly engages a corresponding portion of the lever ring 16, namely, the appropriate part of the wall surface 18. In addition, the interior surface of the container wall 15, above the lever ring 16 and below the rolled edge 17, is an annular surface which is concentric with the lever ring wall surface 18, while the lid 1 includes an annular surface, viz. the exterior surface 20 of the flange 5, which is concentric with the lid 1 per se. As the lid surface 20 contacts the interior surface of the container wall 15, this tends to maintain the lid fins 11 and the container wall surface 18 in a concentric and therefore sealed relationship. Any misalignment which might occur, if the rim of the flange 5 did not extend out to and contact the container wall, is thus obviated and the lid 1 and the container lever ring 15 naturally assume an accurately-coaxial relationship, in which the fins 11 exert a full sealing function.

Figure 2:
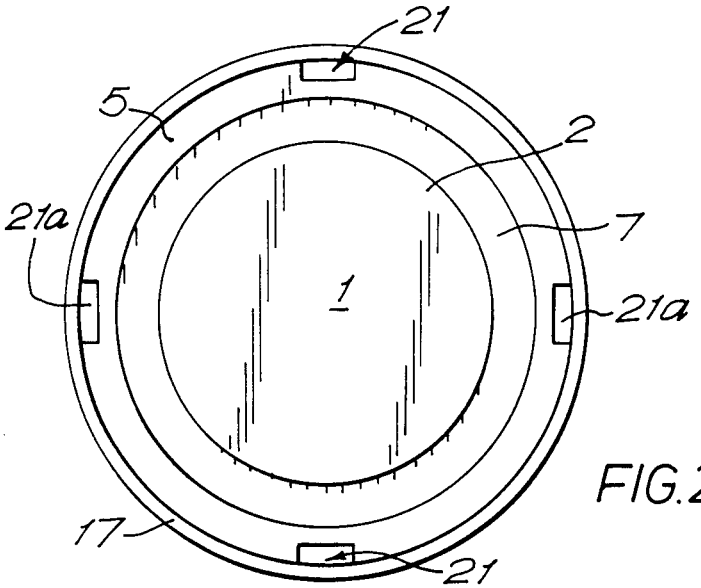
FIG. 2 shows a plan view of the assembled paint can and lid of FIG. 1.

In order to enable the lid 1 to be removed readily from the body of the can, at least one recess is provided, as indicated by an arrow 21, two such recesses 21 being shown in FIG. 2 at diametrically-opposite places at the periphery of the lid 1. Each recess 21 can be a generally rectangular gap in the outer part of the flange 5, having an inner vertical wall 22, indicated as a broken line in FIG. 1. Instead of taking the form of a gap in the entire thickness of the flange 5, as shown at 21, each recess 21 can include a membrane **21*a* which constitutes a thin part of the flange 5, as shown at two other diametrically-opposite places at the periphery of the lid 1. The membrane 21*a* (or one of them, if two or more recess 21 are provided) has to be pierced and so becomes ruptured, when the can is first opened. This form of recess thus gives evidence of opening of the can and makes the cap or lid 1 tamper-evident. A prospective purchaser can readily see whether any membrane 21*a* in the lid 1 of a paint can is undamaged and that the can has therefore not been opened since manufacture. The one or more recesses 21 allow a lever, such as the blade of a screwdriver, to be inserted between the lid 1 and the interior of the rolled edge 17 of the can body, after rupturing the membrane 21*a*, where this is provided, so that the lid 1 can be easily removed from the can body so as to open the latter. When this is done, the lower fin 12 is first displaced relatively downwardly, as the wall 4 rises, where the leverage is being applied, relative to the dependent web 14. It is found, in practice, that it is almost impossible to break the seal or otherwise disturb the position of the lid 1 in relation to the can body until the can is to be opened and that it is a relatively simple matter to use a simple lever in one or other of the recesses 21 to allow removal of the lid 1 to be effected. In order to re-close the can, it is a relatively simple matter to press the lid into the circular aperture defined by the annular web 14 and to maintain this pressure until the fins 11 have been brought into sealing engagement again with the interior surface of the web 14, the lower fin 12 has restored itself into the locking position beneath the rolled edge 13 and the external surface 20 of the flange 5 of the lid has again come into abutting contact with the interior surface of the can body wall 15 in the region between the rolled edge 17 and the lever ring 16**.

Figure 3:
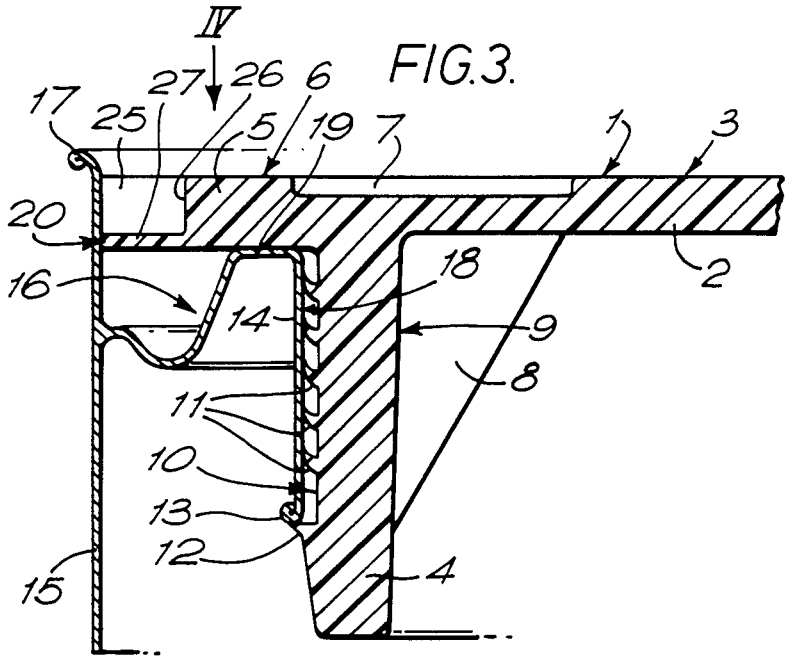
FIG. 3 shows a radial cross-sectional view, similar to FIG. 1, through a lid and container lever ring according to another preferred embodiment of the invention.
Figure 4:
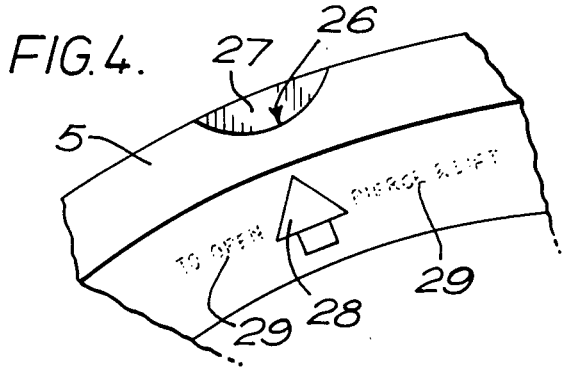
FIG. 4 shows in fragmentary plan view a detail of the lid of FIG. 3, in the direction of the arrow IV shown in FIG. 3.

Referring to FIGS. 3 and 4, like parts to those shown in and described above in relation to FIGS. 1 and 2, have the same reference numbers. In this embodiment, a single arcuate recess 25 is provided in the lid flange 5 and is defined between the exterior surface 20 of the lid 1, an arcuate surface 26 and the upper surface of a thin membrane 27 which forms the base of the recess 25. The periphery of the membrane 27 contacts the can wall at its chuck wall diameter. As shown in FIG. 4, an indicator, such as an arrow 28, indicating the position of the recess 25 can be printed on, molded into or otherwise provided on the upper surface 6 of the flange 5 and instructions as to how to open the can by prying off the lid 1 can be similarly provided, e.g. in the form of suitable wording 29.

The membrane 27 is much thinner than the lid flange 5 and, as the lid 1 is made of a plastic material, a lever, e.g. a screwdriver blade, can easily be made to pierce the membrane 27 in order to exert leverage between the rolled edge 17 and the underside of the flange 5 inwardly of the recess 25. This leverage allows the lid 1 to be removed. The lid 1 can then be put back upon and removed from the can as often as desired, whereby the contents remain in a satisfactory state, as a seal is made by the fins 11 and 12 and also by contact between the flange 5 and the lever ring portion 19. Also, as the membrane 27 becomes ruptured by the lever used, when the lid 1 is first removed, it provides a clear indication as to whether the can has remained closed since manufacture and the first application of the lid, after the can has been filled. A ruptured membrane 27 provides clear evidence that the lid 1 of a can has been tampered with, so that this embodiment of the invention provides tamper-evident lids for containers.

Figure 5:
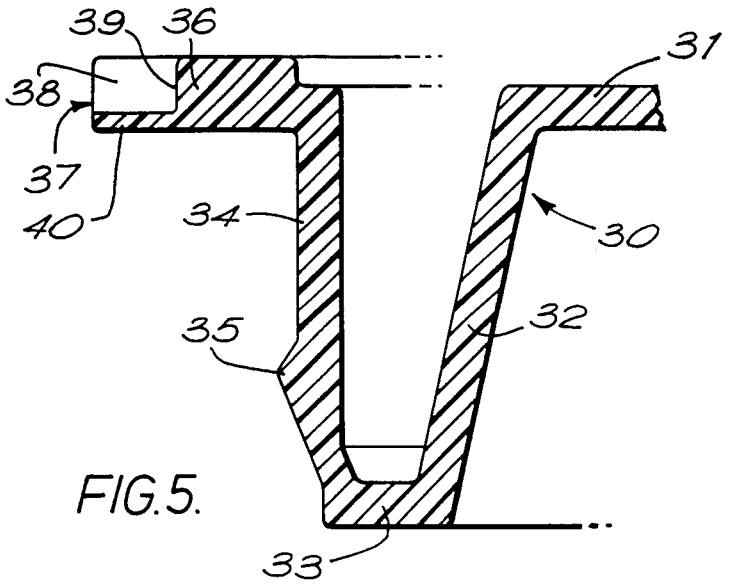
FIG. 5 shows a radial cross-sectional view of the periphery of a lid, according to a further preferred embodiment of the invention; and, FIG. 6 shows diagrammatically in perspective view a detail of the periphery of a can lid according to the invention when it has been pried from its can in order to open the latter.

FIG. 5 illustrates an embodiment in which the tamper-evident means for opening the can are provided upon a lid which does not having sealing fins.

The lid 30 shown comprises a one-piece plastic molding, having a central circular panel 31, a downwardly- and slightly outwardly-angled first annular wall 32, joined at its top to the panel 31 and and its bottom to an annular flange 33, an upwardly-directed second annular wall 34, preferably incorporating an outwardly-facing sealing bead 35, the wall 34 being joined at its bottom to the flange 33 and at its top to another annular flange 36 incorporating the circular rim 37 of the lid 30. A recess 38, similar to the recess 25 shown in FIGS. 3 and 4 and including a rear arcuate surface 39 and a lower membrane 40, is provided at the periphery of the lid 30. An arrow and other markings, such as those shown at 28 and 29 in FIG. 4, can be provided. Again, the first use of a lever to pierce the membrane 40 causes it to rupture, so that unauthorized opening is made evident, although this does not prevent further use of the lid 30 to close the associated can.

Figure 6:
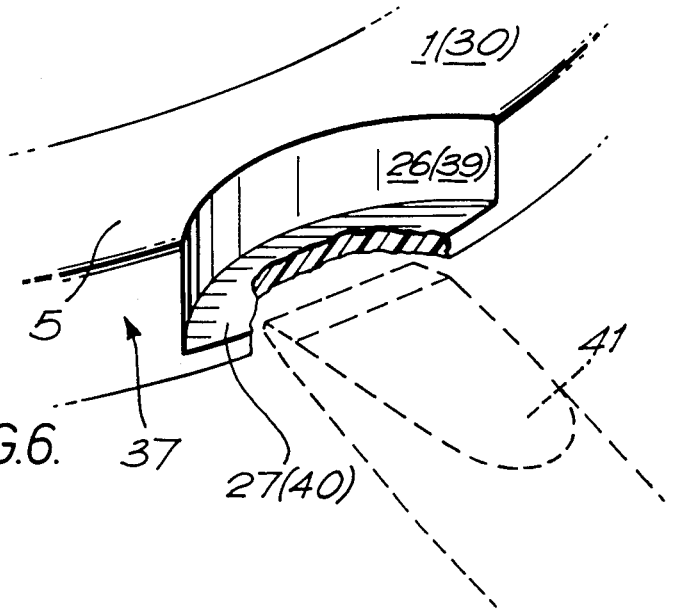

FIG. 6 shows in diagrammatic perspective view of how the membrane, e.g 21*a*, 27 or 40, in the lid 1 or 30, appears, after a screwdriver, shown in dotted lines at 41, has been used to pry the lid from its container.

The membrane, such as shown at 27 or 40, need not be provided at the underside of the flange 5. If the top surface of the membrane is level with that of the lid per se, a shallow groove defining the position of the arcuate surface, e.g. 26 or 39, can be incorporated in the top surface of the lid 5 or some other means can be provided on the lid 5 to indicate the location of the membrane and the underlying recess.

I claim:

1. A lid comprising a central panel having an integral depending flange and a surrounding integral outwardly-directed flange for engaging with a corresponding portion of a lever ring of a container to which the lid is fitted with the lever ring having an annular wall and cooperating with said depending flange to provide an annular seal, said depending flange having outwardly-projecting fins flexed to provide a primary seal between said lid and lever ring with the lowermost of said fins having a flat upper wall adapted to engage a lower edge of said annular wall, said lever ring having flat annular surface surrounding said annular wall with said outwardly-directed flange providing a secondary seal with said flat annular surface and in which said container and lever ring have an annular container surface located outwardly and above said annular wall for engagement by a peripheral edge of said outwardly-directed flange to center said depending flange with respect to said annular wall, said outwardly-directed flange having at least one recess for receiving a lever for assisting in removal of the lid to open the container with said recess having a membrane which is ruptured when said lever is inserted into said recess, whereby said lid is made tamper-evident.

2. A lid having a lid portion for sealingly engaging with a corresponding portion of a lever ring of a container to which the lid is to be fitted, wherein the container includes a flange projecting outwardly and having an annular inwardly-facing portion defining an annular surface concentric with the container portion and the lid includes a flange projecting outwardly from the lid portion and defining an annular surface concetric with the lid portion and arranged to contact the annular surface of the container and thereby maintain the lid and container portions in a concentric and thereby sealed relationship, said flange of said lid having at least one recess for receiving a lever for assisting in removal of the lid to open the container.

3. A lid comprising a central panel having an integral depending flange and a surrounding integral outwardly-directed flange for engaging with a corresponding portion of a ring lever of a container to which the lid is fitted with the ring lever having an annular wall cooperating with said depending flange to provide an annular seal, said outwardly-directed flange having at least one recess for receiving a lever for assisting in removal of the lid to open the container with said recess having a membrane which is ruptured when said lever is inserted into said recess to provide a tamper-evident feature for said lid.

4. A lid according to claim 2, in which said at least one recess includes a membrane which is ruptured or otherwise displaced when a lever is first used to assist removal of the lid from the associated container, whereby the lid is made tamper-evident.

5. A lid according to claim 4, in which said membrane extends so as to contact the annular surface of the container.

6. A lid according to claim 4, in which said membrane is located adjacent the underside of the flange.

* * * * *